US008714717B2

(12) United States Patent
Okina

(10) Patent No.: US 8,714,717 B2
(45) Date of Patent: May 6, 2014

(54) AGITATING DEVICE AND LIQUID EJECTING APPARATUS

(75) Inventor: Takuya Okina, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/367,177

(22) Filed: Feb. 6, 2012

(65) Prior Publication Data

US 2012/0200645 A1 Aug. 9, 2012

(30) Foreign Application Priority Data

Feb. 7, 2011 (JP) ..... 2011-023954

(51) Int. Cl.
*B41J 2/175* (2006.01)
*B41J 2/195* (2006.01)
*B41J 2/17* (2006.01)

(52) U.S. Cl.
USPC ..... 347/85; 347/7; 347/84

(58) Field of Classification Search
USPC ..... 347/7, 84, 85, 86
See application file for complete search history.

(56) References Cited

U.S. PATENT DOCUMENTS

2010/0053280 A1 * 3/2010 Ohashi et al. ..... 347/86

FOREIGN PATENT DOCUMENTS

JP 2010-205022 9/2010

* cited by examiner

*Primary Examiner* — Jannelle M Lebron
(74) *Attorney, Agent, or Firm* — Workman Nydegger

(57) ABSTRACT

An agitating device includes: a movement portion which is provided in a liquid accommodation portion that has an accommodation chamber accommodating a liquid containing a functional material and a deformation portion that is deformed so as to change a volume of the accommodation chamber, and is moved along with deformation of the deformation portion; and an agitating portion which agitates the liquid in the accommodation chamber along with movement of the movement portion.

20 Claims, 6 Drawing Sheets

AGITATING DEVICE AND LIQUID EJECTING APPARATUS

BACKGROUND

1. Technical Field

The present invention relates to an agitating device and a liquid ejecting apparatus.

2. Related Art

As a liquid ejecting apparatus that ejects liquid, an ink jet type printing apparatus is known. As the configuration of the ink jet type printing apparatus, a configuration including a pressure adjustment mechanism for temporarily storing ink containing functional materials such as pigments, dyes, resins, fine metal particles, and in a state of suppressing a pressure change in the temporarily stored ink, supplying the ink to a liquid ejecting head is known (for example, refer to JP-A-2010-205022). In the pressure adjustment mechanism, an ink chamber that accommodates the ink is provided.

In the related art described above, in a case where the liquid is left for a predetermined period or the like, there are problems in that components contained in the ink in the ink chamber are precipitated and thus a distribution of density of the ink occurs.

SUMMARY

An advantage of some aspects of the invention is that it provides an agitating device and a liquid ejecting apparatus capable of suppressing precipitation of functional materials.

According to an aspect of the invention, there is provided an agitating device including: a movement portion which is provided in a liquid accommodation portion that has an accommodation chamber accommodating a liquid containing a functional material and a deformation portion that is deformed so as to change a volume of the accommodation chamber, and is moved along with deformation of the deformation portion; and an agitating portion which agitates the liquid in the accommodation chamber along with movement of the movement portion.

According to the aspect of the invention, the movement portion is moved along with the deformation of the deformation portion and the agitating portion agitates the liquid in the accommodation chamber along with the movement of the movement portion, so that the ink in the accommodation chamber can be agitated without providing a driving mechanism that drives an additional agitating portion. Accordingly, precipitation of the functional material can be suppressed, and the configuration of the device avoids being complicated. In addition, as the functional material contained in the liquid, there are coloring materials such as pigments or dyes, resins, fine metal particles, and the like.

It is preferable that, in the agitating device, the agitating portion be formed to be moved integrally with the movement portion.

According to the aspect of the invention, since the agitating portion is formed to be moved integrally with the movement portion, the liquid in the accommodation chamber can be more reliably agitated in the case where the movement is moved.

It is preferable that, in the agitating device, the agitating portion have a pressing member which presses the liquid in a movement direction of the movement portion.

According to the aspect of the invention, since the agitating portion has the pressing member which presses the liquid in the movement direction of the movement portion, a flow of the liquid in the accommodation chamber can be formed in a predetermined direction. Accordingly, the liquid in the accommodation chamber can be more reliably agitated.

It is preferable that, in the agitating device, the pressing member have a protruding portion which protrudes in a direction intersecting the movement direction.

According to the aspect of the invention, since the pressing member has the protruding portion which protrudes in the direction intersecting the movement direction, the liquid in the accommodation chamber can be stirred by the protruding portion. Accordingly, the liquid in the accommodation chamber can be more reliably agitated.

It is preferable that, in the agitating device, a part of the protruding portion be disposed at a lower end portion of the accommodation chamber in the direction of gravity.

According to the aspect of the invention, since the part of the protruding portion is disposed at the lower end portion of the accommodation chamber in the direction of gravity, the functional material precipitated in the accommodation chamber can be efficiently agitated.

It is preferable that, in the agitating device, the agitating portion have a rotation member which is rotated in at least one of a clockwise direction and a counterclockwise direction as viewed in a movement direction of the movement portion.

According to the aspect of the invention, since the agitating portion has the rotation member which is rotated in at least one of a clockwise direction and a counterclockwise direction as viewed in the movement direction of the movement portion, the liquid in the accommodation chamber can be more efficiently agitated.

It is preferable that, in the agitating device, the rotation member have a second protruding portion which protrudes in a direction intersecting the movement direction.

According to the aspect of the invention, since the rotation member has the second protruding portion which protrudes in the direction intersecting the movement direction, the liquid in the accommodation chamber can be stirred by the second protruding portion. Accordingly, the liquid in the accommodation chamber can be more reliably agitated.

It is preferable that, in the agitating device, an end portion of the second protruding portion be bent in the movement direction.

According to the aspect of the invention, since the end portion of the second protruding portion is bent in the movement direction, during the movement of the pressing member, a resistant of the liquid added to the bent portion can be reduced. Accordingly, a configuration in which the pressing member is easily moved can be achieved.

It is preferable that, in the agitating device, the liquid accommodation portion be provided in a flow path which connects a liquid ejecting head that ejects the liquid and a liquid supply portion that supplies the liquid to the liquid ejecting head to each other.

According to the aspect of the invention, since the liquid accommodation portion is provided in the flow path which connects the liquid ejecting head that ejects the liquid and the liquid supply portion that supplies the liquid to the liquid ejecting head to each other, a liquid in which the density of the functional material is uniform can be supplied to the liquid ejecting head.

According to another aspect of the invention, there is provided a liquid ejecting apparatus including: a liquid ejecting head which ejects a liquid supplied from a liquid storage portion that stores the liquid in which a functional material is dissolved or dispersed; a flow path which connects the liquid ejecting head to the liquid storage portion; a liquid accommodation portion which is provided in the flow path, and has an accommodation chamber that accommodates the liquid and a deformation portion that is deformed so as to change a volume of the accommodation chamber; a pressure adjustment unit which adjusts a pressure of the liquid supplied to the liquid ejecting head by deforming the deformation portion and thus changing the volume of the accommodation chamber; and an agitating device having an agitating portion that agitates the liquid in the accommodation chamber, wherein the agitating device described in the above aspect is used as the agitating device.

According to the aspect of the invention, since the agitating device capable of suppressing precipitation of the functional material and avoiding a complicated configuration of the device is provided, a liquid in which the density of the functional material is uniform can be supplied to the liquid ejecting head. Accordingly, variations in the density of the functional material in the ejected liquid can be prevented.

It is preferable that, in the liquid ejecting apparatus, the pressure adjustment unit have an on-off valve which switches opening and blocking of the flow path between the liquid supply portion and the liquid accommodation portion in the flow path, and the on-off valve serve as the movement portion.

According to the aspect of the invention, since the pressure adjustment unit has the on-off valve which switches opening and blocking of the flow path between the liquid supply portion and the liquid accommodation portion in the flow path, and the on-off valve serves as the movement portion, the liquid in the liquid accommodation portion can be efficiently agitated along with a pressure adjustment operation of the pressure adjustment unit.

It is preferable that, in the liquid ejecting apparatus, the on-off valve have a shaft portion disposed so as to penetrate through the accommodation chamber from a predetermined part, and the agitating portion be provided in the shaft portion.

According to the aspect of the invention, since the agitating portion is provided in a part of the on-off valve, compared to a case where they are provided separately, saving space can be achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described with reference to the drawings.

First Embodiment

Figure 1:
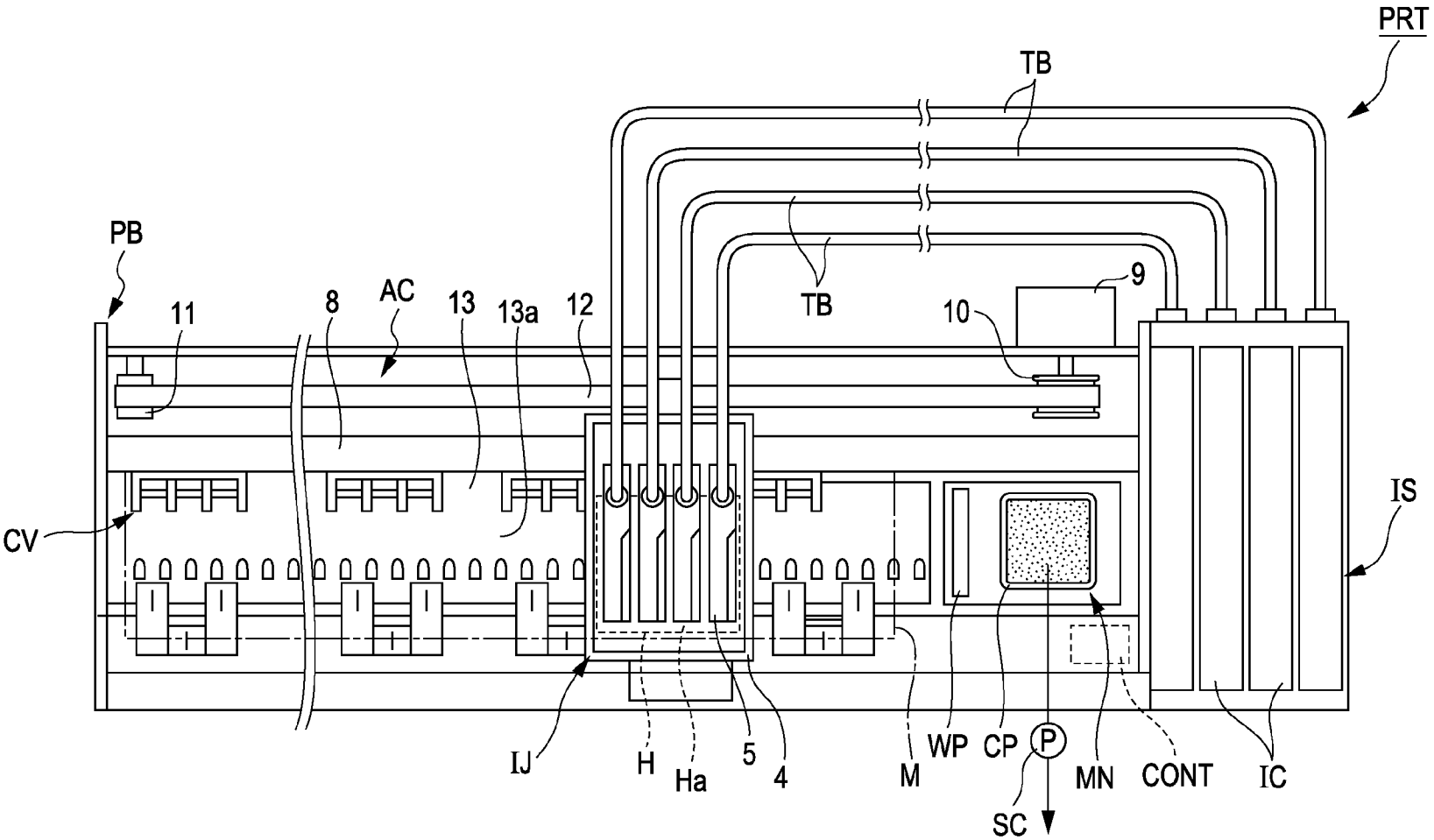
FIG. 1 is a diagram illustrating the overall configuration of a printing apparatus according to a first embodiment of the invention.

FIG. 1 is a diagram illustrating a schematic configuration of a printing apparatus PRT (liquid ejecting apparatus) according to a first embodiment of the invention. In this embodiment, as the printing apparatus PRT, an ink jet type printing apparatus is exemplified. Ink cartridges IC are mounted in the printing apparatus PRT.

The printing apparatus PRT illustrated in FIG. 1 is an apparatus that performs a printing process while transporting a sheet-like medium M such as paper or a plastic sheet. The printing apparatus PRT includes a housing PB, an ink jet mechanism IJ that ejects ink onto the medium M, an ink supply mechanism IS that supplies ink to the ink jet mechanism IJ, a transportation mechanism CV that transports the medium M, a maintenance mechanism MN that performs a maintenance operation of the ink jet mechanism IJ, and a control device CONT that controls the mechanisms.

The housing PB is formed to have a direction as a longitudinal direction. In the housing PB, each unit of the ink jet mechanism IJ, the ink supply mechanism IS, the transportation mechanism CV, the maintenance mechanism MN, and the control device CONT is mounted. A platen 13 is provided in the housing PB. The platen 13 is a support member that supports the medium M. The platen 13 has a flat support surface 13*a* that faces the medium M. The support surface 13*a* is a surface that supports the medium M.

The transportation mechanism CV has a transportation roller, a motor that drives the transportation roller, and the like. The transportation mechanism CV transports the medium M in a lateral direction of the housing PB so that the medium M passes on the platen 13. Transportation timings or transportation amounts of the transportation mechanism CV are controlled by the control device CONT.

The ink jet mechanism IJ has a head H that ejects the ink and a head movement mechanism AC that holds and moves the head H. The head H ejects the ink onto the medium M send out on the platen 13. The head H has an ejection surface Ha onto which the ink is ejected. The ejection surface Ha is disposed in a state of facing the support surface 13*a*. The ejection surface Ha is provided with a plurality of nozzles NZ that eject the ink.

The head movement mechanism AC moves the head H in the longitudinal direction of the housing PB. The head movement mechanism AC has a carriage 4 to which the head H is fixed. The carriage 4 abuts on a guide shaft 8 suspended in the longitudinal direction of the housing PB. The head movement mechanism AC has mechanisms that move the carriage 4 along the guide shaft 8, for example, a pulse motor 9, a driving pulley 10, a freely rotating pulley 11, and a timing belt 12.

The maintenance mechanism MN is provided in a region (home position) deviating from a region where printing is performed on the medium M. The maintenance mechanism MN has a capping mechanism CP that covers the ejection surface Ha of the head H, a wiping mechanism WP that wipes the ejection surface Ha, and the like. A suction mechanism SC such as a suction pump is connected to the capping mechanism CP. Waste ink discharged from the head H to the maintenance mechanism MN side is recovered by a waste water recovery mechanism (not shown).

The ink supply mechanism IS supplies ink to the head H. The ink contains functional materials. As the functional materials, there are coloring materials such as pigments or dyes, resins, fine metal particles, and the like. A plurality of ink cartridges IC are accommodated in the ink supply mechanism IS. The printing apparatus PRT of this embodiment has a configuration (off-carriage type) in which the ink cartridges IC are mounted at a different position from the head H.

The ink supply mechanism IS has a pressurization mechanism 6 that can individually adjust internal pressures of the respective ink cartridges IC. The ink supply mechanism IS has a supply tube TB connected to each of the ink cartridges IC. The supply tubes TB are connected to the head H via respective pressure adjustment units 5.

Figure 2:
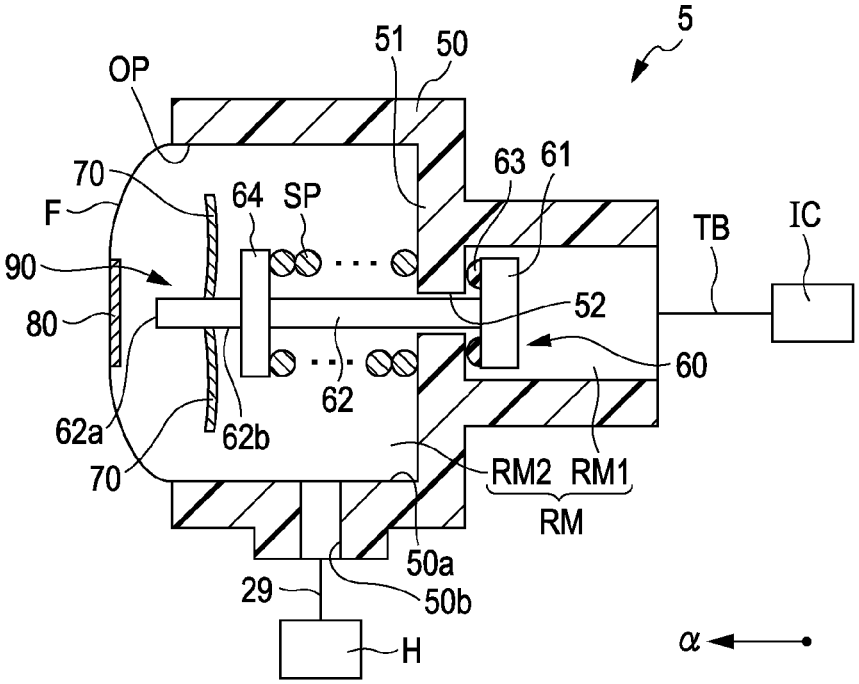
FIG. 2 is a cross-sectional view illustrating the configuration of a pressure adjustment mechanism according to the embodiment.

FIG. 2 is a cross-sectional view illustrating the configuration of the pressure adjustment mechanism 5.

As illustrated in FIG. 2, the pressure adjustment unit 5 has an accommodation chamber formation member 50 that is formed using a resin material such as polypropylene. An ink accommodation chamber (accommodation chamber) RM is formed in the accommodation chamber formation member 50. A partitioning portion 51 is formed in the accommodation chamber formation member 50. The ink accommodation chamber RM is partitioned into a first chamber RM1 and a second chamber RM2 by the partitioning portion 51. The first and second chambers RM1 and RM2 are adjacent to each other and lined up with the partitioning portion 51 interposed therebetween. Hereinafter, the direction of the first and second chambers RM1 and RM2 which are lined up is referred to as an α direction.

The first chamber RM1 of the ink accommodation chamber RM is connected to the ink cartridge IC via the supply tube TB. In the second chamber RM2, an inner wall surface 50*a* of the accommodation chamber formation member 50 is provided with an opening portion 50*b*. The second chamber RM2 is connected to the head H via the opening portion 50*b* and a connection flow path 29. The first and second chambers RM1 and RM2 communicate with each other via a communication portion 52 provided in the partitioning portion 51. As described above, the ink supply mechanism IS (ink cartridge IC), the supply tube TB, the first chamber RM1, the communication portion 52, the second chamber RM2, the opening portion 50*b*, the connection flow path 29, and the head H communicate in this order from the ink supply mechanism IS to the head H.

A part of the wall portion of the accommodation chamber formation member 50 which surrounds the second chamber RM2 is provided with an opening portion OP. The opening portion OP is formed to cause the second chamber RM2 and the outer portion of the ink accommodation chamber RM to communicate with each other. A flexible member (deformation portion) F which can be elastically deformed is bonded to the opening portion OP. The opening portion OP enters a state of being blocked by the flexible member F.

As the flexible member F, a film formed of a resin or the like may be used. The flexible member F is provided with a pressure receiving plate 80. The pressure receiving plate 80 is mounted at the center portion of the flexible member F. A part of the flexible member F disposed at the periphery of the pressure receiving plate 80 is provided to be contracted between the pressure receiving plate 80 and the wall portion of the second chamber RM2.

A valve (movement portion) 60 which switches opening and blocking of the communication portion 52 is provided in the ink accommodation chamber RM. The valve 60 is disposed in the first and second chambers RM1 and RM2. The valve 60 has a flange portion 61 and a shaft portion 62. The flange portion 61 is provided in the first chamber RM1. The flange portion 61 is formed in a disk shape. The flange portion 61 is provided with a seal portion 63 that blocks the communication portion 52. The communication portion 52 is sealed as the seal portion 63 abuts on the partitioning portion 51.

The shaft portion 62 is disposed to penetrate through the communication portion 52. A direction parallel to the α direction is the longitudinal direction of the shaft portion 62. The parallel direction mentioned here includes a direction deviated at about 0° to 5° with respect to the α direction. An end portion 62*a* on the opposite side to the flange portion 61 in the shaft portion 62 is disposed to face the pressure receiving plate 80 of the second chamber RM2. An impelling member support portion 64 that supports an impelling member SP described later is provided in the shaft portion 62 between the end portion 62*a* that faces the pressure receiving plate 80 and the flange portion 61. The impelling member support portion 64 is formed in a disk shape like the flange portion 61.

Figure 3:
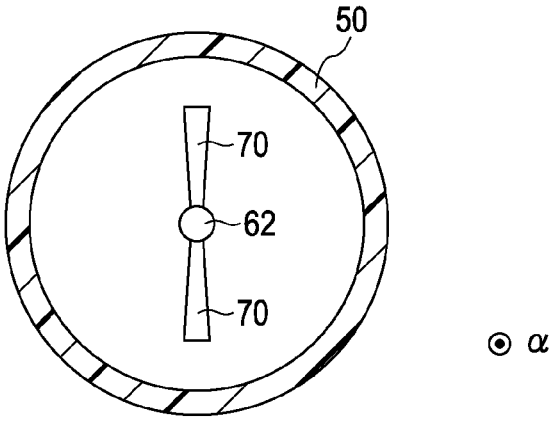
FIG. 3 is a diagram illustrating the configuration of a part of the pressure adjustment mechanism according to the embodiment.

The end portion 62*a* of the shaft portion 62 is provided with a protruding portion 70 that protrudes in a direction orthogonal to the longitudinal direction (α direction) of the shaft portion 62. The orthogonal direction mentioned here includes a direction deviated at about 0° to 5° with respect to the direction orthogonal to the longitudinal direction of the shaft portion 62. An intermediate portion 62*b* is provided between the end portion 62*a* and the impelling member support portion 64 in the shaft portion 62. The protruding portion 70 is provided at the intermediate portion 62*b*. The protruding portion 70 agitates ink accommodated in the second chamber RM2. FIG. 3 is a diagram schematically illustrating the configuration of the shaft portion 62 as viewed from the flexible member F side. As illustrated in FIGS. 2 and 3, the protruding portion 70 is formed so that the width thereof is gradually increased as it becomes distant from the shaft portion 62.

A pair of the protruding portions 70 are provided at positions interposing the shaft portion 62 therebetween. The protruding portion 70 is formed with a uniform thickness in an extension direction of the shaft portion 62. The thickness of the protruding portion 70 is formed as a dimension in which the protruding portion 70 has flexibility in the extension direction of the shaft portion 62. The protruding portions 70 and the shaft portion 62 are formed into one member. In this embodiment, an agitating device 90 that agitates the ink in the second chamber RM2 is constituted by the valve 60 and the protruding portion 70.

The impelling member SP is disposed between the impelling member support portion 64 and the inner wall surface 50*a* of the second chamber RM2 on the right in the figure. As the impelling member SP, a spring member or the like is appropriately used. The impelling member SP impels the impelling member support portion 64 against the flexible member F side with a predetermined impelling force. By the impelling force, the flange portion 61 is pressed against the partitioning portion 51 and the seal portion 63 is maintained in a state of abutting on the partitioning portion 51 (a state where the communication portion 52 is blocked).

When the flexible member F is bent in a direction so as to reduce the inner volume of the ink accommodation chamber RM (a direction so as to narrow the second chamber RM2), the flexible member F and the pressure receiving plate 80 presses the end portion 62*a* of the shaft portion 62 in a direction approaching the first chamber RM1 side from the second chamber RM2 side. When the pressing force becomes greater than the impelling force by the impelling member SP, the seal portion 63 is moved in a direction further away from the partitioning portion 51, so that the communication portion 52 enters the opened state.

Therefore, by appropriately setting the impelling force of the impelling member SP, a configuration in which the communication portion 52 is opened by the seal portion 63 when the ink accommodation chamber RM has a smaller pressure than a predetermined pressure and in other cases the communication portion 52 is blocked by the seal portion 63. As the predetermined pressure, atmospheric pressure or the like may be employed. As a factor that reduces the pressure of the ink accommodation chamber RM to be lower than the predetermined pressure, there are a negative pressure generated by ejection of ink during an ejection operation, a negative pressure generated by suction of nozzles NZ, and the like.

Next, an operation of the printing apparatus PRT configured as described above will be described.

In a case where a printing operation is performed by the head H, the control device CONT causes the medium M to be disposed on the −Z side of the head H by the transportation mechanism CV. After the medium M is disposed, the control device CONT inputs a driving signal for the nozzles NZ on the basis of image data of an image to be printed while moving the head H. When the driving signal is input to the head H, ink is ejected from the nozzles NZ. By the ink ejected from the nozzles NZ, a desired image is formed on the medium M.

Figure 4:
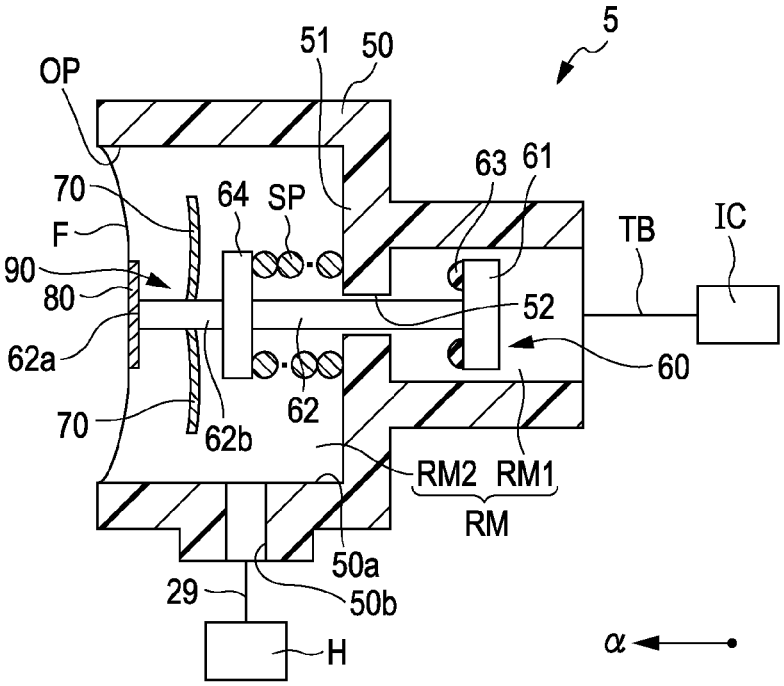
FIG. 4 is a cross-sectional view illustrating the operation of the pressure adjustment mechanism according to the embodiment.

When the printing operation is performed, in a case where the ink is ejected from the head H in a state where the seal portion 63 blocks the communication portion 52 (the state illustrated in FIG. 2), a flow path from the second chamber RM2 to the head H has a negative pressure due to a reduction in the ink. By the negative pressure, the flexible member F is bent toward the inside of the second chamber RM2. When a force of the flexible member F and the pressure receiving plate 80 pressing the shaft portion 62 is greater than the impelling force of the impelling member SP, as illustrated in FIG. 4, the shaft portion 62 is pressed against the first chamber RM1 side, such that the communication portion 52 is opened. Here, the pressure receiving plate 80 functions as a receiving portion when the shaft portion 62 is pressed.

Since the first chamber RM1 communicates with the ink supply mechanism IS and the second chamber RM2 communicates with the head H, when the communication portion 52 that communicates the first and second chambers RM1 and RM2 with each other is opened, ink is supplied to the second chamber RM2 side from the first chamber RM1 through the communication portion 52. As the ink is supplied, the negative pressure from the second chamber RM2 to the head H is reduced, and thus the flexible member F is more likely to be bent toward the outside of the second chamber RM2. When the impelling force of the impelling member SP becomes greater than the force of the flexible member F and the pressure receiving plate 80 pressing the shaft portion 62, the seal portion 63 enters a state of blocking the communication portion 52 by the impelling force.

As described above, the pressure adjustment unit 5 has a function of adjusting the ink meniscus of the nozzles by causing the head H to have a negative pressure from the second chamber RM2, and a function as a check valve (one-way valve) through which ink flows only in a direction from the first chamber RM1 to the second chambers RM2.

In addition, when the pressure adjustment unit 5 performs an operation of switching opening and closing of the communication portion 52, the pressure receiving plate 80 is reciprocated in the extension direction of the shaft portion 62 by the bending operation of the flexible member F. By the reciprocation movement of the pressure receiving plate 80, the protruding portions 70 provided in the shaft portion 62 are reciprocated in the extension direction of the shaft portion 62 integrally with the shaft portion 62. By the reciprocation movement of the protruding portions 70, the ink in the second chamber RM2 is pressed in the movement direction of the protruding portions 70, such that the ink in the second chamber RM2 is agitated.

In a case where the printing apparatus PRT is left for a predetermined period after finishing a single printing operation until the subsequent printing operation is performed, or the like, coloring materials contained in the ink in the second chamber RM2 of the ink accommodation chamber RM and the like are precipitated, and a distribution of density of the ink may be formed.

For this, in this embodiment, the pressure receiving plate 80 is moved according to the deformation of the flexible member F, and the protruding portions 70 of the valve 60 agitate the ink in the second chamber RM2 according to the movement of the pressure receiving plate 80, so that the ink in the second chamber RM2 can be agitated without providing a driving mechanism that drives an additional agitating portion. Accordingly, precipitation of components contained in the ink such as the coloring materials can be suppressed, and the configuration of the device avoids being complicated.

Second Embodiment

Next, a second embodiment of the invention will be described.

Figure 5:
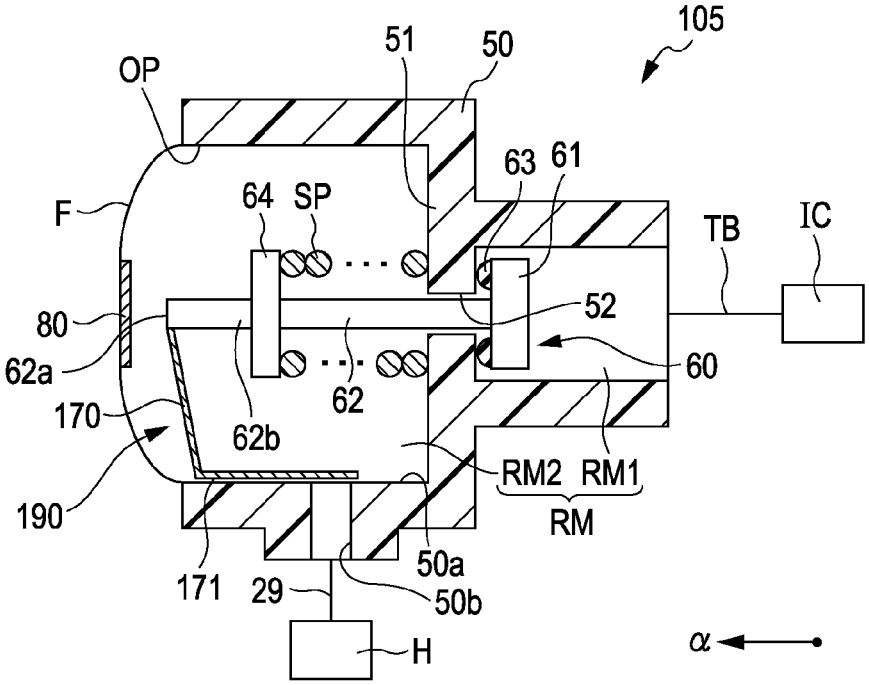
FIG. 5 is a cross-sectional view illustrating the configuration of a pressure adjustment mechanism according to a second embodiment of the invention.
Figure 6:
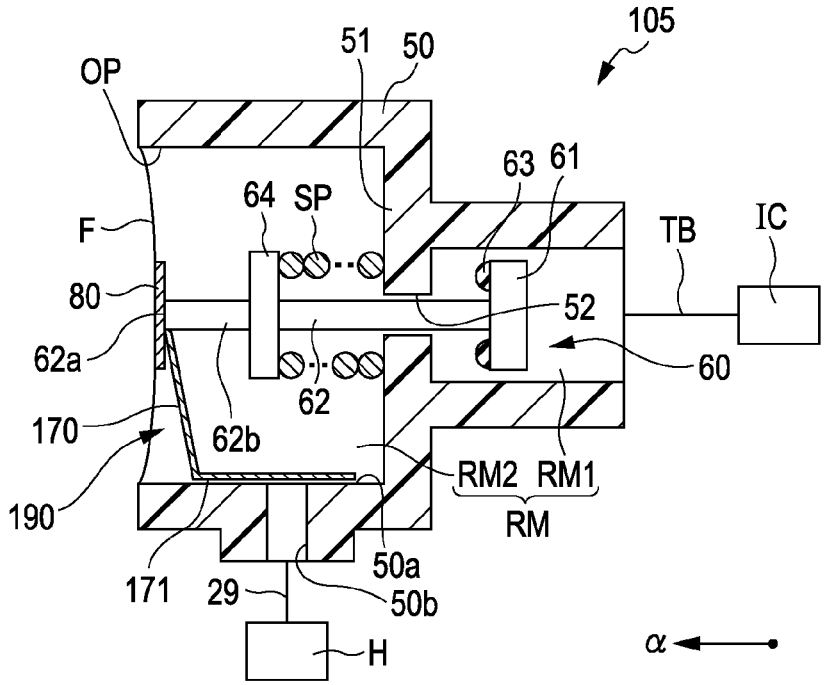
FIG. 6 is a cross-sectional view illustrating the operation of the pressure adjustment mechanism according to the embodiment.

FIG. 5 is a cross-sectional view illustrating the configuration of a pressure adjustment unit 105 according to this embodiment.

As illustrated in FIG. 5, the pressure adjustment unit 105 has a protruding portion 170 at the end portion 62*a* of the shaft portion 62. In this embodiment, an agitating device 190 is constituted by the valve 60 and the protruding portion 170. In FIG. 5, the downward direction in the figure is described as the direction of gravity (a direction in which ink is supplied to the head H from the second chamber RM2).

The protruding portion 170 extends in the direction of gravity from the end portion 62*a* of the shaft portion 62 toward the inner wall surface 50*a* of the accommodation chamber formation member 50. The tip end portion of the protruding portion 170 in the direction of gravity is bent to be parallel to the extension direction of the shaft portion 62 (a bent portion 171). The parallel direction mentioned here includes a direction deviated at about 0° to 5° with respect to the extension direction of the shaft portion 62. The bent portion 171 is disposed at a lower end portion of the second chamber RM2 in the direction of gravity.

As the pressure receiving plate 80 is reciprocated in the extension direction of the shaft portion 62, the protruding portion 170 and the bent portion 171 provided in the shaft portion 62 are reciprocated in the extension direction of the shaft portion 62 integrally with the shaft portion 62. By the reciprocation movement of the protruding portion 170 and the bent portion 171, the ink in the second chamber RM2 is pressed in the movement direction of the protruding portion 170 and the bent portion 171, such that the ink in the second chamber RM2 is agitated.

As described above, according to this embodiment, since the protruding portion 170 is formed to extend downward in the direction of gravity and the bent portion 171 is disposed at the lower end portion of the second chamber RM2 in the direction of gravity, in the case where the protruding portion 170 and the bent portion 171 are moved along with the movement of the pressure receiving plate 80 and the shaft portion 62, ink in a part of the second chamber RM2 where coloring materials of the ink or the like are more likely to be precipitated can be efficiently agitated.

The technical scope of the invention is not limited to the embodiments, and various modifications can be added in a range without departing from the gist of the invention.

Figure 7:
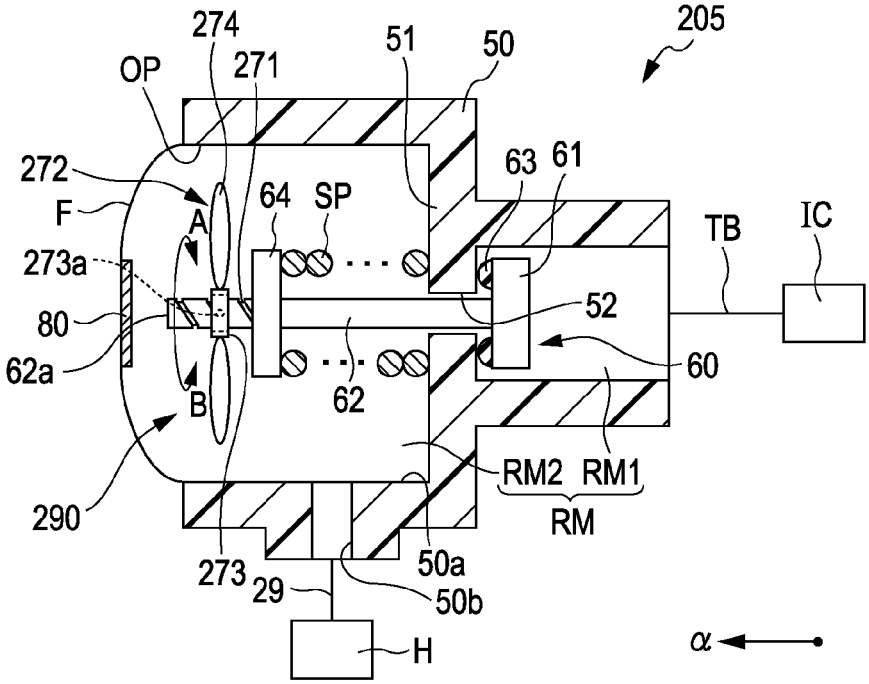
FIG. 7 is a cross-sectional view illustrating another configuration of the pressure adjustment mechanism of the printing apparatus according to the embodiment of the invention.

FIG. 7 is a cross-sectional view illustrating the configuration of a pressure adjustment unit 205 according to this embodiment.

As illustrated in FIG. 7, the pressure adjustment unit 205 is different from the configuration of the first embodiment in that it has a spiral-shaped groove portion 271 provided at the shaft portion 62 and a propeller portion 272 connected to the groove portion 271 as an agitating device 290.

The groove portion 271 is formed to proceed clockwise from the end portion 62*a* of the shaft portion 62 toward the impelling member support portion 64. The propeller portion 272 has a rotation member 273 and a blade member 274. The rotation member 273 is formed in a ring shape. The inner peripheral surface of the rotation member 273 is provided with an engagement portion 273*a* engaged with the groove portion 271. The rotation member 273 is supported by a support member (not shown) so as to rotate in a circumferential direction, and movement thereof in the extension direction of the shaft portion 62 is restricted. The blade member 274 is fixed to the rotation member 273.

Figure 8:
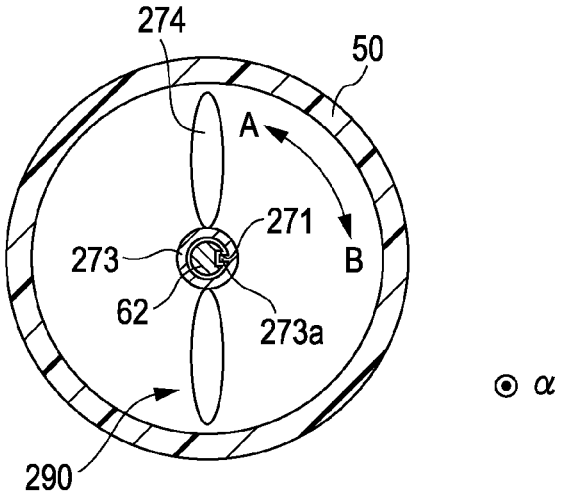
FIG. 8 is a cross-sectional view illustrating another configuration of the pressure adjustment mechanism of the printing apparatus according to the embodiment of the invention.

FIG. 8 is a cross-sectional view illustrating the configuration of the shaft portion 62 as viewed from the pressure receiving plate 80 side. As illustrated in FIG. 8, when the rotation member 273 is rotated in the circumferential direction, the engagement portion 273*a* is moved in the circumferential direction by the rotation of the rotation member 273. In FIG. 8, a counterclockwise direction when the shaft portion 62 is viewed from the pressure receiving plate 80 side is represented as a "direction A", and a clockwise direction when the shaft portion 62 is viewed from the pressure receiving plate 80 side is represented as a "direction B".

Figure 9:
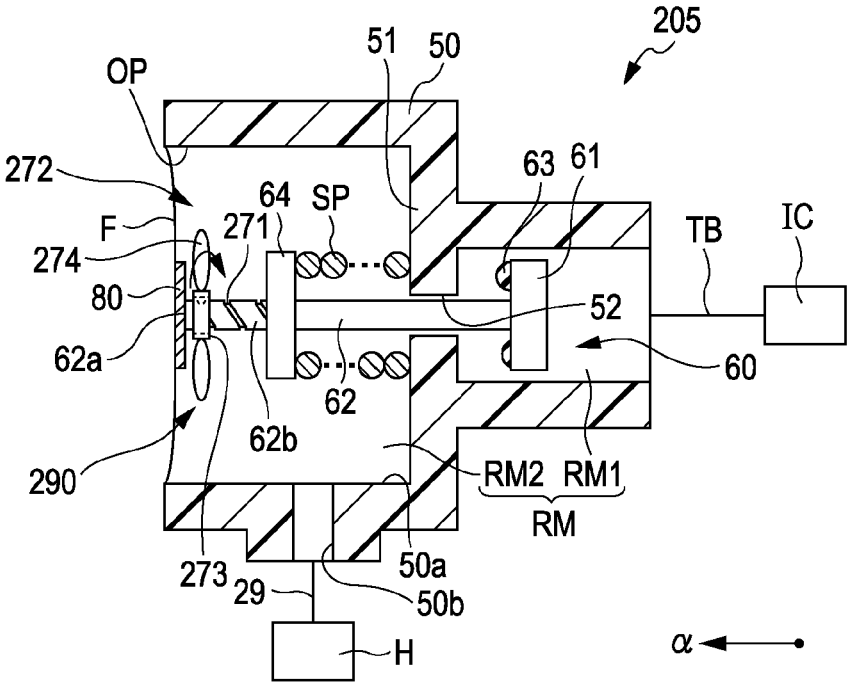
FIG. 9 is a cross-sectional view illustrating another configuration of the pressure adjustment mechanism of the printing apparatus according to the embodiment of the invention.

In such a configuration, when the ink in the second chamber RM2 is ejected from the head H and thus is consumed, the second chamber RM2 has a negative pressure, and the flexible member F is deformed toward the inside of the second chamber RM2. By the deformation of the flexible member F, the pressure receiving plate 80 is moved toward the inside of the second chamber RM2. By the movement of the pressure receiving plate 80, the shaft portion 62 is moved so as to be pressed against the first chamber RM1 side, and as illustrated in FIG. 9, the seal portion 63 opens the communication portion 52.

Here, as the shaft portion 62 is moved toward the first chamber RM1 side, the groove portion 271 formed in a spiral shape is moved toward the first chamber RM1 side. By the movement of the groove portion 271, a part of the groove portion 271 overlapping with the rotation member 273 is moved in the circumferential direction of the rotation member 273, that is, in the direction A. Since the movement of the rotation member 273 in the extension direction of the shaft portion 62 is restricted, the engagement portion 273*a* engaged with the groove portion 271 is moved along the groove portion 271, and the rotation member 273 is rotated in the direction A. By the rotation of the rotation member 273, the ink in the second chamber RM2 is agitated by the blade member 274.

In addition, when ink is supplied to the second chamber RM2 side from the first chamber RM1 through the communication portion 52, as in the first embodiment, the flexible member F is deformed so as to be bent toward the outside of the second chamber RM2. When the impelling force of the impelling member SP becomes greater than the force of the flexible member F and the pressure receiving plate 80 pressing the shaft portion 62, the shaft portion 62 is moved toward the second chamber RM2 side, and thus the seal portion 63 enters a state of blocking the communication portion 52.

Here, by the movement of the shaft portion 62 toward the second chamber RM2 side, the groove portion 271 formed in the spiral shape is moved toward the second chamber RM2 side. By the movement of the groove portion 271, a part of the groove portion 271 overlapping with the rotation member 273 is moved in the circumferential direction of the rotation member 273, that is, in the direction B. Since the movement of the rotation member 273 in the extension direction of the shaft portion 62 is restricted, the engagement portion 273*a* engaged with the groove portion 271 is moved along the groove portion 271, and the rotation member 273 is rotated in the direction B. By the rotation of the rotation member 273, the ink in the second chamber RM2 is agitated by the blade member 274.

According to this embodiment, along with the movement of the shaft portion 62, the rotation member 273 and the blade member 274 are rotated in the directions A and B of the circumferential direction which are switched. By converting the straight movement of the shaft portion 62 into rotation movement of the rotation member 273 and the blade member 274, the ink in the second chamber RM2 can be efficiently agitated. In addition, a configuration in which a weight is mounted on the tip end of the blade member 274 may also be employed. Accordingly, the agitating force of the blade member 274 can be increased.

Figure 10:
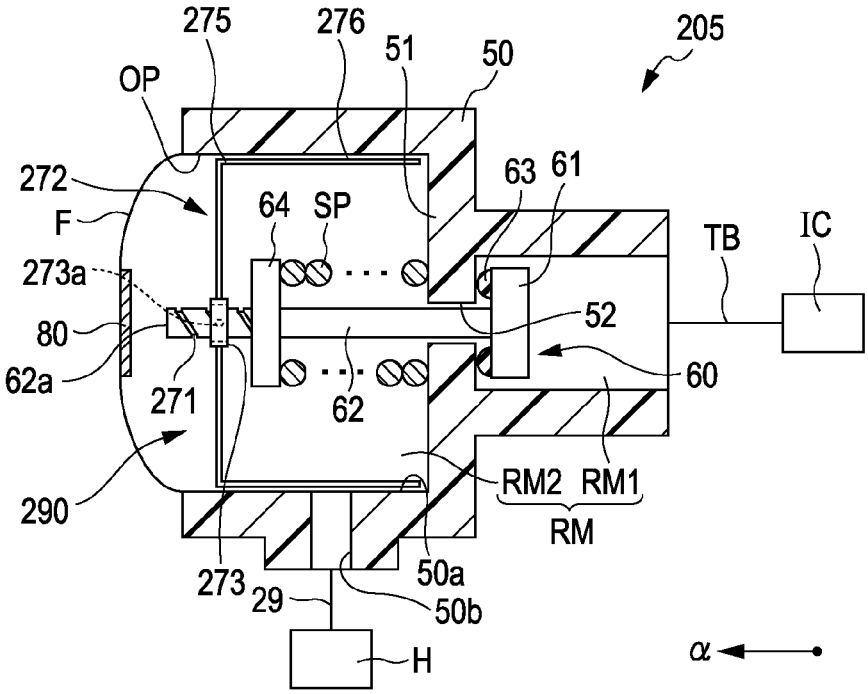
FIG. 10 is a cross-sectional view illustrating another configuration of the pressure adjustment mechanism of the printing apparatus according to the embodiment of the invention.

In addition, as illustrated in FIG. 10, a configuration in which a protruding portion 275 is mounted on a rotation member 273 and a part of the protruding portion 275 which reaches the inner wall surface 50*a* of the accommodation chamber formation member 50 is bent so as to be parallel to the shaft portion 62, that is, a configuration having a bent portion 276 may be employed. In this case, ink in the lower end portion of the second chamber RM2 in the direction of gravity (a direction in which the ink is supplied from the second chamber RM2 to the head H, that is, the downward direction of FIG. 10) where components of the ink are more likely to be precipitated can be efficiently agitated.

In addition, in each of the embodiments, a configuration in which a part of the impelling member support portion 64 has a penetration portion that penetrates through the shaft portion 62 in the extension direction may be employed. In this configuration, ink can pass through the penetration portion as the shaft portion 62 is moved. Therefore, ink in a part of the second chamber RM2 can be agitated.

In addition to the configuration of each of the embodiments, for example, a configuration in which the valve 60 is moved along with the movement of the head H may also be employed.

In the embodiments described above, the printing apparatus that employs the ink jet type as a printing type is described but may also be modified to a printing apparatus in an arbitrary printing type such as an electrophotographic type or a thermal transfer type. In addition, the printing apparatus is not limited to a printer and may be a FAX device, a copying device, or a multi-function peripheral having a plurality of functions thereof. Moreover, as the recording apparatus, a liquid ejecting apparatus having a liquid ejecting head that ejects or discharges a minute amount of liquid droplets of a liquid other than ink, and the like may be employed.

In addition, the liquid droplets represent liquid states discharged from the liquid ejecting apparatus, the liquid states including granular, tear-like, and thread-like shapes with trails. The liquid mentioned herein may be any material that can be ejected by the liquid ejecting apparatus. For example, the materials may be in a liquid phase, and may include liquid-state materials with high or low viscosities, sol, gel water, fluid-state materials such as inorganic solvents, organic solvents, solutions, liquid resins, and liquid metal (metallic melt), and in addition to liquids as a state of the material, a material in which particles of functional materials made of solids such as pigments or metallic particles are dissolved, dispersed, or mixed with the solvent. In addition, as a representative example of the liquid, there is the ink described above in the embodiment or a liquid crystal.

Here, the ink may include various kinds of liquid compositions such as general water-based ink, oil-based ink, gel ink, hot-melt ink, and the like. Specific examples of the liquid ejecting apparatus may include liquid crystal displays, EL (electroluminescence) displays, surface light-emitting displays, liquid ejecting apparatuses for ejecting liquid in which materials such as electrode materials used for manufacturing color filters and color materials are dispersed or dissolved, and printing apparatuses.

The entire disclosure of Japanese Patent Application No. 2011-023954, filed Feb. 7, 2011 is expressly incorporated by reference herein.

What is claimed is:

1. An agitating device comprising:

a movement portion which is provided in an accommodation chamber accommodating a liquid;

a deformation portion that is configured to deform so as to change a volume of the accommodation chamber, wherein the movement portion is pressed by the deformation portion; and an agitating portion which is provided with the movement portion, wherein the agitating portion agitates the liquid in the accommodation chamber along with movement of the movement portion.

2. The agitating device according to claim 1, wherein the agitating portion is formed to be moved integrally with the movement portion.

3. The agitating device according to claim 1, wherein the agitating portion is provided in a part of the movement portion.

4. The agitating device according to claim 1, wherein the liquid accommodation portion is provided in a flow path which connects a liquid ejecting head that ejects the liquid and a liquid supply portion that supplies the liquid to the liquid ejecting head to each other.

5. The agitating device according to claim 1, wherein the agitating portion has a pressing member which presses the liquid in a movement direction of the movement portion.

6. The agitating device according to claim 5, wherein the pressing member has a protruding portion which protrudes in a direction intersecting the movement direction.

7. The agitating device according to claim 6, wherein a part of the protruding portion is disposed at a lower end portion of the accommodation chamber in the direction of gravity.

8. The agitating device according to claim 1, wherein the agitating portion has a rotation member which is rotated in at least one of a clockwise direction and a counterclockwise direction as viewed in a movement direction of the movement portion.

9. The agitating device according to claim 8, wherein the rotation member has a second protruding portion which protrudes in a direction intersecting the movement direction.

10. The agitating device according to claim 9, wherein an end portion of the second protruding portion is bent in the movement direction.

11. A liquid ejecting apparatus comprising:

a liquid ejecting head which ejects a liquid supplied from a liquid storage portion that stores the liquid in which a functional material is dissolved or dispersed;

a flow path which connects the liquid ejecting head to the liquid storage portion;

a liquid accommodation portion which is provided in the flow path, and has an accommodation chamber that accommodates the liquid and a deformation portion that is deformed so as to change a volume of the accommodation chamber;

a pressure adjustment unit which adjusts a pressure of the liquid supplied to the liquid ejecting head by deforming the deformation portion and thus changing the volume of the accommodation chamber; and an agitating device having an agitating portion that agitates the liquid in the accommodation chamber, wherein the agitating device according to claim 1 is used as the agitating device.

12. The liquid ejecting apparatus according to claim 11, wherein the pressure adjustment unit has an on-off valve which switches opening and blocking of the flow path between the liquid supply portion and the liquid accommodation portion in the flow path, and the on-off valve serves as the movement portion.

13. The liquid ejecting apparatus according to claim 12, wherein the on-off valve has a shaft portion disposed so as to penetrate through the accommodation chamber from a predetermined part, and the agitating portion is provided in the shaft portion.

14. A liquid ejecting apparatus comprising:

a liquid ejecting head which ejects a liquid supplied from a liquid storage portion that stores the liquid in which a functional material is dissolved or dispersed;

a flow path which connects the liquid ejecting head to the liquid storage portion;

a liquid accommodation portion which is provided in the flow path, and has an accommodation chamber that accommodates the liquid and a deformation portion that is deformed so as to change a volume of the accommodation chamber;

a pressure adjustment unit which adjusts a pressure of the liquid supplied to the liquid ejecting head by deforming the deformation portion and thus changing the volume of the accommodation chamber; and an agitating device having an agitating portion that agitates the liquid in the accommodation chamber, wherein the agitating device according to claim 2 is used as the agitating device.

15. A liquid ejecting apparatus comprising:

a liquid ejecting head which ejects a liquid supplied from a liquid storage portion that stores the liquid in which a functional material is dissolved or dispersed;

a flow path which connects the liquid ejecting head to the liquid storage portion;

a liquid accommodation portion which is provided in the flow path, and has an accommodation chamber that accommodates the liquid and a deformation portion that is deformed so as to change a volume of the accommodation chamber;

a pressure adjustment unit which adjusts a pressure of the liquid supplied to the liquid ejecting head by deforming the deformation portion and thus changing the volume of the accommodation chamber; and an agitating device having an agitating portion that agitates the liquid in the accommodation chamber, wherein the agitating device according to claim 5 is used as the agitating device.

16. A liquid ejecting apparatus comprising:

a liquid ejecting head which ejects a liquid supplied from a liquid storage portion that stores the liquid in which a functional material is dissolved or dispersed;

a flow path which connects the liquid ejecting head to the liquid storage portion;

a liquid accommodation portion which is provided in the flow path, and has an accommodation chamber that accommodates the liquid and a deformation portion that is deformed so as to change a volume of the accommodation chamber;

a pressure adjustment unit which adjusts a pressure of the liquid supplied to the liquid ejecting head by deforming the deformation portion and thus changing the volume of the accommodation chamber; and an agitating device having an agitating portion that agitates the liquid in the accommodation chamber, wherein the agitating device according to claim 6 is used as the agitating device.

17. A liquid ejecting apparatus comprising:

a liquid ejecting head which ejects a liquid supplied from a liquid storage portion that stores the liquid in which a functional material is dissolved or dispersed;

a flow path which connects the liquid ejecting head to the liquid storage portion;

a liquid accommodation portion which is provided in the flow path, and has an accommodation chamber that accommodates the liquid and a deformation portion that is deformed so as to change a volume of the accommodation chamber;

a pressure adjustment unit which adjusts a pressure of the liquid supplied to the liquid ejecting head by deforming the deformation portion and thus changing the volume of the accommodation chamber; and an agitating device having an agitating portion that agitates the liquid in the accommodation chamber, wherein the agitating device according to claim 7 is used as the agitating device.

18. A liquid ejecting apparatus comprising:

a liquid ejecting head which ejects a liquid supplied from a liquid storage portion that stores the liquid in which a functional material is dissolved or dispersed;

a flow path which connects the liquid ejecting head to the liquid storage portion;

a liquid accommodation portion which is provided in the flow path, and has an accommodation chamber that accommodates the liquid and a deformation portion that is deformed so as to change a volume of the accommodation chamber;

a pressure adjustment unit which adjusts a pressure of the liquid supplied to the liquid ejecting head by deforming the deformation portion and thus changing the volume of the accommodation chamber; and an agitating device having an agitating portion that agitates the liquid in the accommodation chamber, wherein the agitating device according to claim 8 is used as the agitating device.

19. A liquid ejecting apparatus comprising:

a liquid ejecting head which ejects a liquid supplied from a liquid storage portion that stores the liquid in which a functional material is dissolved or dispersed;

a flow path which connects the liquid ejecting head to the liquid storage portion;

a liquid accommodation portion which is provided in the flow path, and has an accommodation chamber that accommodates the liquid and a deformation portion that is deformed so as to change a volume of the accommodation chamber;

a pressure adjustment unit which adjusts a pressure of the liquid supplied to the liquid ejecting head by deforming the deformation portion and thus changing the volume of the accommodation chamber; and an agitating device having an agitating portion that agitates the liquid in the accommodation chamber, wherein the agitating device according to claim 9 is used as the agitating device.

20. A liquid ejecting apparatus comprising:

a liquid ejecting head which ejects a liquid supplied from a liquid storage portion that stores the liquid in which a functional material is dissolved or dispersed;

a flow path which connects the liquid ejecting head to the liquid storage portion;

a liquid accommodation portion which is provided in the flow path, and has an accommodation chamber that accommodates the liquid and a deformation portion that is deformed so as to change a volume of the accommodation chamber;

a pressure adjustment unit which adjusts a pressure of the liquid supplied to the liquid ejecting head by deforming the deformation portion and thus changing the volume of the accommodation chamber; and an agitating device having an agitating portion that agitates the liquid in the accommodation chamber, wherein the agitating device according to claim 10 is used as the agitating device.

* * * * *